United States Patent [19]

Raskin

[11] 4,196,652

[45] Apr. 8, 1980

[54] DIGITAL ELECTRONIC TUNER

[76] Inventor: Jef Raskin, P.O. Box 11044-A, Palo Alto, Calif. 94306

[21] Appl. No.: 751,024

[22] Filed: Dec. 16, 1976

Related U.S. Application Data

[62] Division of Ser. No. 498,451, Aug. 19, 1974, abandoned.

[51] Int. Cl.[2] ..... G10G 7/00

[52] U.S. Cl. ..... 84/458; 84/454

[58] Field of Search ..... 84/453, 454, 455, 458, 84/459; 318/696

[56] References Cited

U.S. PATENT DOCUMENTS

| | | | |
|---|---|---|---|
| 2,881,320 | 4/1959 | Goldberg | 250/36 |
| 3,016,475 | 1/1962 | Kirsten | 315/84.6 |
| 3,144,802 | 8/1964 | Faber | 84/454 |
| 3,304,504 | 2/1967 | Horlander | 328/72 |
| 3,461,392 | 8/1969 | Hughes | 329/104 |
| 3,577,178 | 5/1911 | Hawley | 324/83 D |
| 3,696,293 | 10/1972 | Hoffmann | 324/78 Q |
| 3,745,475 | 7/1973 | Turner | 328/134 |
| 3,745,544 | 7/1973 | Ono | 340/206 |
| 3,745,559 | 7/1973 | Mattem | 340/347 AD |
| 3,813,983 | 6/1974 | Paul | 84/454 |
| 3,820,022 | 6/1974 | Watt | 324/83 D |
| 3,845,615 | 11/1974 | Cake | 58/50 R |
| 3,861,266 | 1/1975 | Whitaker | 84/454 |
| 3,901,120 | 8/1975 | Youngquist | 84/454 |
| 4,014,242 | 3/1977 | Sanderson | 84/454 |
| 4,107,595 | 8/1978 | Campe | 318/696 |

OTHER PUBLICATIONS

Designing with TTL Integrated Circuit, Robert L. Morris, McGraw-Hill Book Co., p. 201.

*Primary Examiner*—Michael L. Gellner
*Assistant Examiner*—S. D. Schreyer
*Attorney, Agent, or Firm*—Ronald E. Grubman

[57] ABSTRACT

A digital electronic tuning device is provided in which an arrangement of light-emitting diodes [LED's] or other display elements indicates when two frequencies are equal. If the frequencies are unequal, the device provides an indication of both the magnitude and direction of the inequality. For use as a tuner of musical instruments, one frequency is provided by a preset clock while the second frequency derives from the musical instrument under test. In operation, a circular pattern of lights on the display elements appears stationary when the instrument is in tune and appears to rotate or spin when the instrument is out of tune. Some information about the harmonic content of the frequency of the signal under test may also be read from the device. In one embodiment, the invention may be used in connection with a stepping motor to automatically tune an instrument.

6 Claims, 6 Drawing Figures

DIGITAL ELECTRONIC TUNER

CROSS REFERENCE TO RELATED APPLICATION

This is a division of application Ser. No. 498,451 filed Aug. 19, 1974, now abandoned.

BACKGROUND OF THE INVENTION

Numerous devices are presently available for the purpose of tuning musical insturments. Some devices known in the art are mechanical, some are electronic, and other operate on electromechanical principles. A typical electromechanical device known in the art includes a tunable sub-audio oscillator which drives a synchronous electronic motor, which in turn rotates a binary-divided strobe disk. Positioned behind the disk is a glow-discharge tube which flickers in response to the output of a musical instrument. Visual observation of the resulting light pattern provides an indication of the frequency. Numerous difficulties are inherent in this device as well as in other mechanical and electromechanical tuning devices. For example, moving parts are included which are subject to degradation with age and dislocation due to external mechanical shocks. Most devices are heavy and otherwise non-portable. A particular limitation of mechanical and electromechanical devices is the restricted range of frequencies over which operation is effective. Typically, operation is not possible below 25 hertz or above 10K hertz.

A few electronic tuning devices are also known in the art. Typically, such devices are null-reading devices and therefore indicate when a signal frequency is precisely equal to a preset frequency, but do not provide any indication of the amount or direction of tuning error when the signal frequency is not precisely at the preset frequency. The electronic devices heretofore known typically utilize analog electronic circuitry and involve frequency-to-voltage conversions to perform the measurement and provide a display. The accuracy of these analog instruments is therefore limited, even when a highly accurate frequency standard is employed.

It would, therefore, be desirable to have available a digital electronic tuning device whose accuracy was concomitant with that obtainable with digital electronics. Preferably, the device should be portable and easy to read. It should indicate when an incoming signal frequency is equal to a preset frequency, and also provide an indication of the magnitude and direction of the tuning error when the signal frequency is not precisely equal to the reference frequency. When the signal under test comprises a complex waveform, the device should give some indication of the harmonic content of that waveform.

SUMMARY OF THE INVENTION

In accordance with the illustrated preferred embodiments, the present invention provides a digital electronic tuning device (hereinafter referred to as a "digi-tuner") particularly well suited for the tuning of musical instruments, but also generally useful whenever the frequencies of any two signals are to be compared. In a preferred embodiment, the device consists of a sequence of lights preferably arranged in a circle. With presently available digital components, eight lights provide a convenient display. Each light is activated by the output of an associated AND gate. According to the invention, one input of each AND gate is the incoming signal whose frequency is to be determined, while the other input is an enabling pulse which activates the AND gates sequentially at a preselected frequency. A simplified description of the operation of the invention is possible if it be assumed that the incoming signal has a frequency which is precisely one-eighth the frequency of the enabling pulses (i.e., the period is eight times the period of the enabling pulses), but has only a 12.5% (one-eighth) duty cycle. Thus, the incoming signal pulse will always be coincident with the enabling pulse for only one of the eight AND gates, and the corresponding LED will blink at the frequency of the enabling pulse. When the frequency is in the audio range or higher, the blinking will occur at a rate above the flicker fusion frequency of the human eye, and the visual appearance will be of one particular light of eight glowing continuously. However, if the incoming signal is not precisely one-eighth the enabling pulse frequency, but is slightly higher, it will progressively coincide with earlier enabling pulses, thereby causing adjacent lights to appear to glow in a moving sequence. In a circular display, the visual appearance will be of a whirling or spinning glow. The apparent direction of spin reverses if the incoming signal is of a lower frequency. When the duty cycle of the incoming signal is greater than 12.5% (e.g., 50% as in a sine wave), then not one light but several lights will glow and appear stationary when the incoming frequency is precisely one-eighth the enabling pulse frequency. When there is a frequency mismatch, the entire pattern of glowing lights will appear to spin, as described above. A similar pattern of glowing and/or spinning lights appears when the waveform is complex.

In accordance with another preferred embodiment of the invention, additional circuitry is included so that the output of each AND gate may drive successive poles of a stepping motor. The stepping motor may then in turn drive a tuning wrench connected to a stringed instrument, thereby effecting the automatic tuning of the instrument.

In accordance with yet another preferred embodiment of the invention, the fundamental frequency of the enabling pulses may be driven by a chromatic scale generator to provide tuning to any note of the chromatic scale.

In accordance with still another preferred embodiment of the invention, a number of individual displays may be employed, each display corresponding to one particular note of the chromatic scale.

It is apparent from the above description that in addition to tuning musical instruments, the invention may be of general applicability for the comparison of any two electronic frequencies. Furthermore, if a magnetic or photoelectric pickup device is employed to supply the input from a desired external signal, the invention may be fruitfully employed as a tachometer.

DETAILED DESCRIPTION OF THE INVENTION

Figure 1:
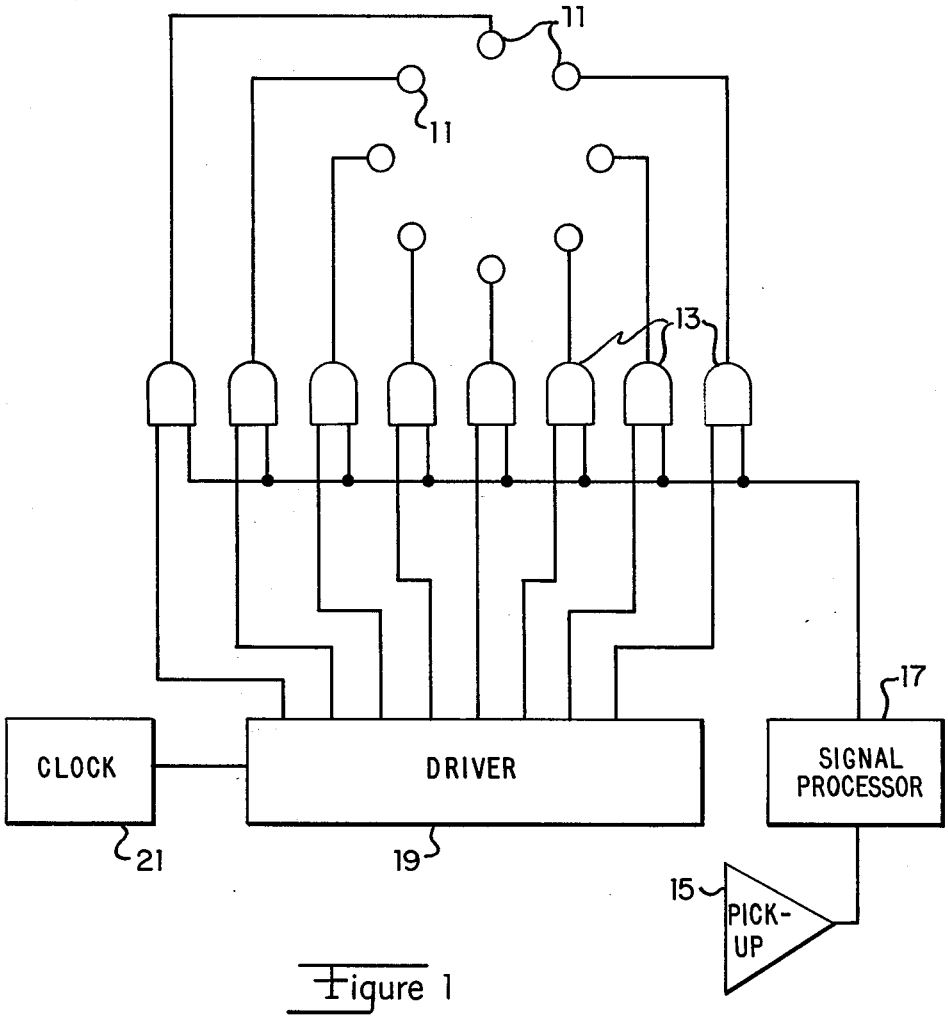
FIG. 1 is a schematic illustration of a preferred embodiment of the present digital electronic tuning device.

In FIG. 1 there are schematically illustrated a number of display elements labeled 11. Display elements 11 are preferably light-emitting diodes [LED's], but other suitable display devices such as liquid crystals or neon bulbs may be employed. In the illustrated embodiment, the display elements are arranged in a circle to provide a particular visual appearance suitable for many purposes. However, the display elements may also be arranged in other configurations such as linear or rectangular arrangements if desired.

Each display element in FIG. 1 is activated by the output of an associated digital logic AND gate, several of which are labeled 13 in the figure. Parallel connection from a pickup device 15 which provides a frequency under test is made to one input of each of the logic AND gates 13. The input device 15 may be any suitable pickup device such as, e.g., a microphone if the desired input signal is from a musical instrument. Other transducers such as inductive pickups or photocells may also be suitable for different applications. The input signal from pickup device 15 is transmitted through a signal processing unit 17 to suitably process the signal before application to the sequence of AND gates 13. Signal processing any be desired, e.g., to modify the input waveform to achieve amplitude and impedance match with the AND gates. For example, a signal derived from a high impedance microphone at 0.001 volt would preferably be signal processed to yield a 5 volt signal at 50 ohms for compatibility with conventional digital logic circuitry. It may also be desirable to shape or filter the input waveform to produce a particular appearance in the output display. For example, signal processing unit 17 may include a comparator or saturation amplifier to produce a square wave from a sine wave; or a low pass filter may be employed to eliminate higher harmonics which are not of interest. Signal processor 17 may also include automatic gain control [AGC] to maintain a level amplitude for consistency of the visual appearance of the output display. AGC is useful, for example, to restore the amplitude generated by a vibrating string as it decays with time.

The second input of each AND gate 13 is driven from one output of a driver unit 19. The basic function of driver 19 is to supply an enabling pulse at a fundamental frequency to each of the AND gates 13 in sequence. Thus, a suitable element known in the art for driver 19 is an N-bit shift register containing a single circulating bit. Presently, eight bit shift registers are commonly available in the present embodiment and would be used in conjunction with eight display elements. For illustrative purposes, a device having eight elements will be discussed hereinafter. It should be apparent, however, that with appropriate digital circuitry, the device may include any desired number of display elements. Driver 19 may also comprise, e.g., a one-out-of-eight counter which produces pulses sequentially at each output when driven at a fundamental clock frequency.

The input to driver 19 is supplied by a clock 21 which may be a crystal-controlled oscillator or other suitable ocillator. Alternately, the frequency may be derived from the line frequency powering the device or from a broadcast standard or from any other suitable clock standard. If desired, another external input may replace the clock if it is desired to use the device to directly compare two frequencies. A particular clock driver will be described below in connection with particular embodiments of the invention.

Figure 2:
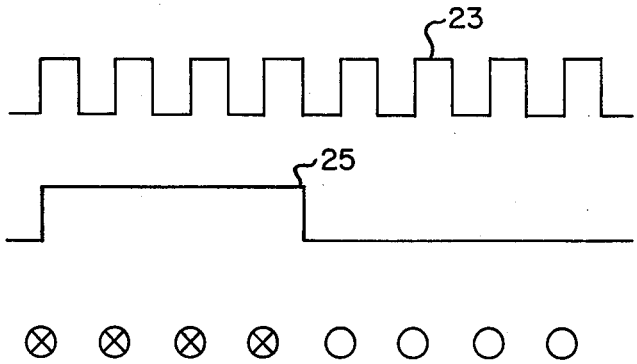
FIG. 2 shows a clock waveform and an input signal under test having a frequency equal to a preset frequency. A pattern appearing on the display elements is shown.
Figure 3:
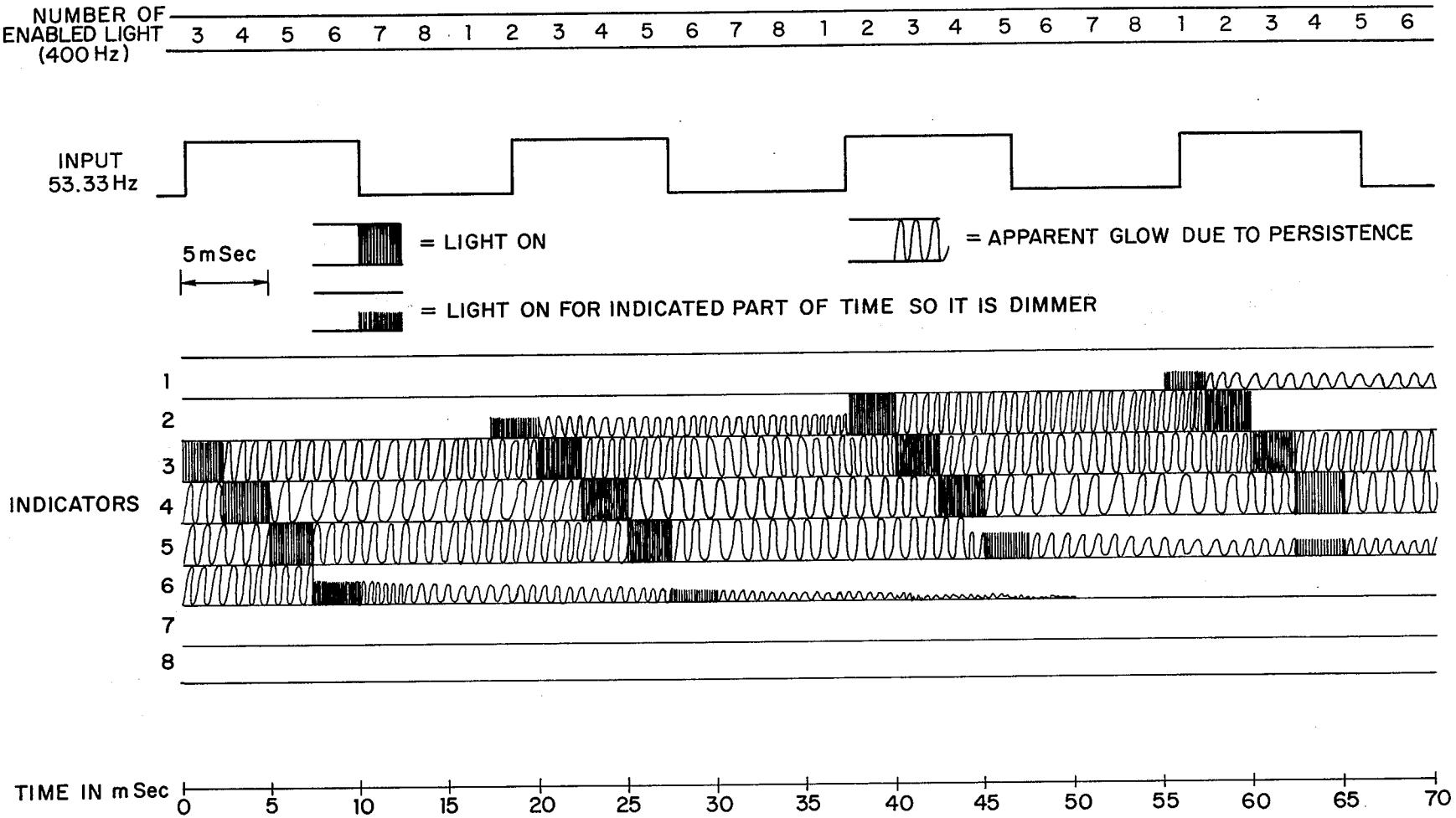
FIG. 3 shows a clock-enabling sequence and an input signal whose frequency differs from the preset frequency. An indication of a resulting time-varying pattern appearing on the display elements is shown.
Figure 4:
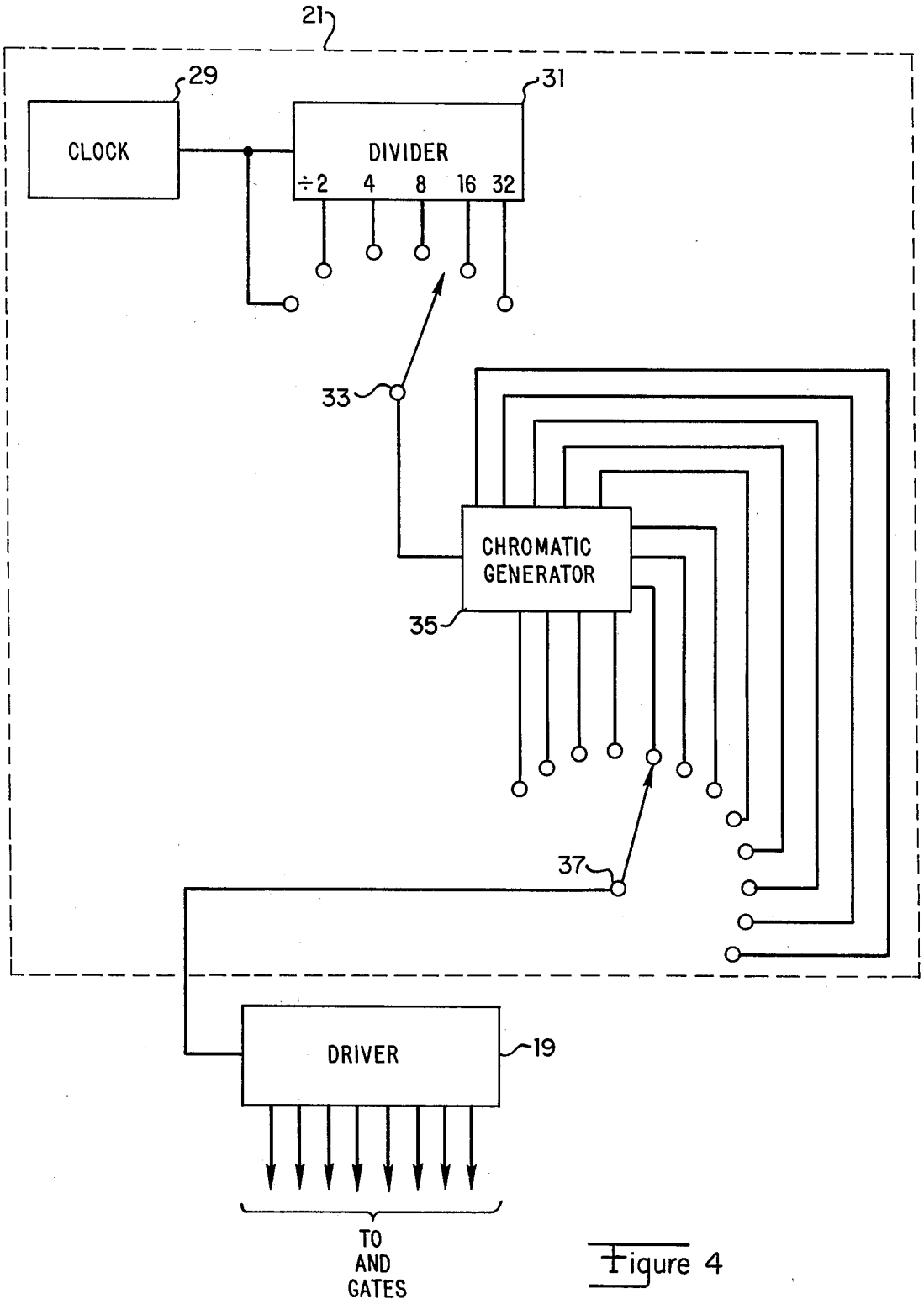
FIG. 4 illustrates an embodiment of the invention using a chromatic generator to provide tuning to notes of the chromatic scale.

Understanding of the operation of the device will be facilitated by reference to FIGS. 2, 3 and 4. In FIG. 2 there is illustrated a waveform 23 which is the basic clock frequency signal from clock 21. For purposes of illustration, this signal is taken to be at a frequency $8f$, where f is a prescribed frequency to which tuning is desired. In response to this clock pulse, driver unit 19 (of FIG. 1) produces an enabling pulse which activates the AND gates in sequence at the periodic frequency f. As discussed above, this may be accomplished by using a circulating shift register containing one bit which is sequentially presented to each AND gate. A second signal 25 is illustrated which represents the output of signal processor 17 being derived from, e.g., a musical instrument by means of pickup 15. In FIG. 2 signal 25 is shown as a square wave of frequency and having a 50% duty cycle. FIG. 2 illustrates a condition in which the frequency of the instrument is precisely in tune with the preselected frequency set on the digituner. A representation of the display elements 11 of FIG. 1 is also shown, in which circular elements containing an "x" indicate an "on" state of the display element, while those not containing an "x" represent an "off" state. As indicated, the "in tune" condition here described will produce a pattern of four lights on and four lights off. More precisely, it can be seen from FIGS. 1 and 2 that input signal 25 will present a logic "high" level to one input of four AND gates coincident with the periodic "high " level produced by the enabling pulse 23 at the other input. The four display elements associated with these gates will therefore flicker at the frequency of the enabling pulses; the remaining four display elements will be "off". If the flicker frequency is in the audio range or higher, it will be above the flicker fusion frequency of the human eye, and the visual appearance will be of four lights "on" and four lights "off" in a stationary pattern. Thus, in the circular display of FIG. 1, a stationary pattern indicates that the frequency under test is precisely equal to the preselected frequency f of the digituner.

FIG. 3 illustrates a condition when the detected signal is at a frequency other than the frequency f. As an example, suppose it is desired to tune to a frequency of 50 Hz. Then the basic clock frequency should be 400 Hz, which will insure that driver 19 produces enabling pulses at 50 Hz. The first line of FIG. 3 indicates which of the eight display elements is enabled at any particular time. A waveform 27 is illustrated at a frequency other than f, here taken as 53.33 Hz, with a duty cycle of 50%. By comparing the "high" or "low" state of the input waveform with the "enabled" or "not enabled" state of such display element, it may be seen that at any particular time certain display elements will be activated. FIG. 3 also indicates a persistent glow of each display element resulting from the response of the human eye; the persistence is shown as being about 20 msec here. It may be seen that as time advances (to the right in the figure), the pattern of flowing display elements appears to shift upward.

If the display elements were arranged in a circle as in FIG. 1, the appearance of the display would consist of a pattern of lights appearing to shift to the right around the circle. This pattern spinning to the right indicates that the frequency of the instrument under test is higher than the preset frequency of the tuning device. If the instrument frequency were below the frequency of the tuning device, the pattern of lights would appear to rotate to the left. The speed of rotation of the pattern indicates the magnitude of the deviation form the desired frequency. The device, therefore, provides an indication of both the magnitude and direction of the deviation from a desired frequency. As described above, a stable pattern clearly indicates when the desired frequency is obtained.

If harmonics of the fundamental frequency are present in the test signal, the display elements will indicate an additional pattern superimposed on the fundamental pattern. As with the fundamental, this pattern will be stationary if the harmonic is precisely in tune, but will rotate if the harmonic is out of tune. A skilled observer may therefore obtain information as to the harmonic content of a signal and to any harmonic mistuning.

In FIG. 4 there is schematically illustrated a particular arrangement of electronic elements to serve as clock 21. Although in general a clock may be used which allows tuning to any preselected frequency, for the tuning of musical instruments, it is desirable to provide tuning to the notes of the chromatic scale. A basic clock 29 is here used to generate a fundamental frequency. Clock 29 drives an octave divider 31 which produces outputs at multiples of the fundamental clock frequency from clock 29. A switch 33 is used to select an appropriate output from octave divider 31 to serve as an input to a chromatic generator 35. Chromatic generators are known in the art and comprise circuitry which generates the twelve notes of a chromatic scale from a given fundamental frequency. Here, a switch 37 is used to select a particular note to be used as the input to driver 19. Tuning of an instrument to particular notes of the chromatic scale is thus provided. For this musical purpose it is especially useful to provide that switch 37 take the form of twelve off-on switches whose physical form is that of the notes of one octave of a piano keyboard.

Figure 5:
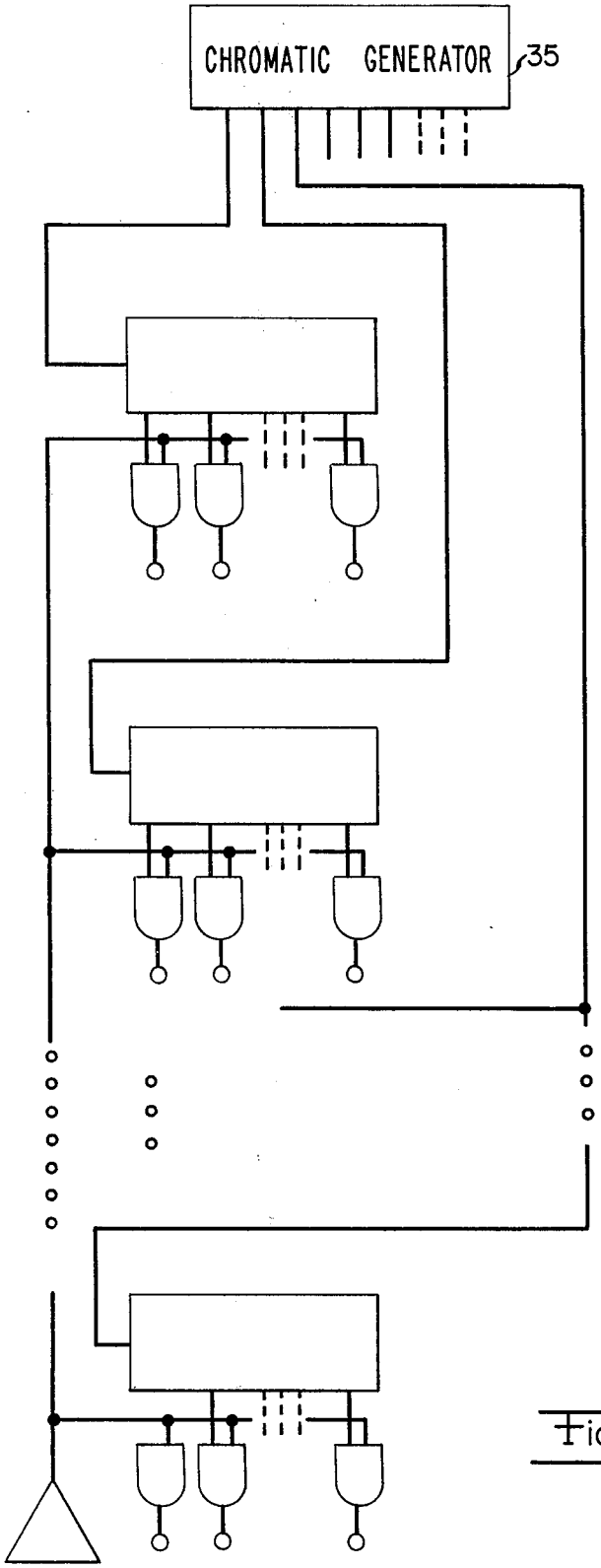
FIG. 5 illustrates am embodiment of the invention in which tuning to different notes of the chromatic scale is displayed on a plurality of display arrangements.

FIG. 5 illustrates an embodiment of the device in which each output of chromatic generator 35 is directed to a different visual display unit. In this embodiment of the invention, the presence in the test signal of a component at a particular frequency of the chromatic scale will be indicated by a stationary pattern on a corresponding display.

Figure 6:
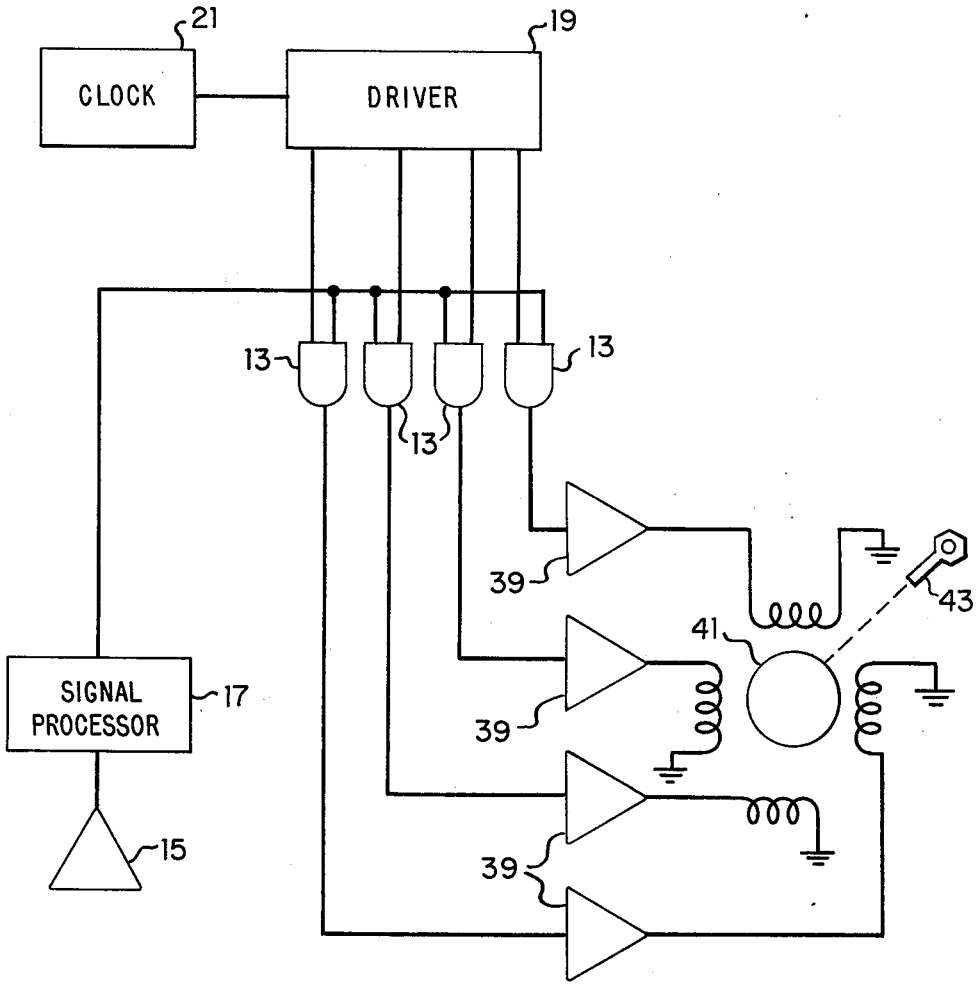
FIG. 6 shows an embodiment of the invention in which the digituner drives a stepping motor to provide automatic tuning of certain instruments.

In FIG. 6 there is illustrated a driver unit 19 shown as a one-out-of-four counter. As before, one input of each gate is supplied by driver 19 while the other inputs of the AND gate are supplied by a signal whose frequency is to be determined. In this embodiment of the invention, however, the outputs of AND gates 13 are directed to four motor driver units 39. These may be any conventional units which serve to process the output signal from AND gates 13 to provide outputs which are suitable for driving a stepping motor, here labeled 41. Other electromechanical devices which respond to the order of a sequence of input pulses are also suitable, e.g., linear motors known in the art. Stepping motor 41 will, therefore, rotate in response to the outputs of AND gates 13 directly, much as the pattern of lights of display elements 11 rotated. The rotation will be in one direction when the instrument frequency is above the desired frequency and in the other direction when it is below the desired frequency. If the stepping motor is connected to a wrench or "tuning hammer", the tuning hammer will rotate also, and may provide automatic tuning of an instrument such as a piano. If desired, the output of AND gates 13 may also be connected in parallel to a visual display unit as described above to provide visual observation of the tuning process.

I claim:

1. An automatic electronic tuning device for tuning a musical instrument, said device comprising:

driving means responsive to a signal of a frequency equal to N times a preselected first frequency for generating N output signals, each output signal being a sequence of enabling pulses at the preselected first frequency;

gating means for gating said sequences of enabling pulses with a signal of a second frequency under test;

a stepping motor having a plurality of N activating coils, each coil being responsive to an associated one of said gated sequences of enabling pulses, to rotate the stepping motor at a rate responsive to the difference between the first and second frequencies; and coupling means interconnected with said stepping motor and said musical instrument for providing automatic tuning of said instrument in response to motion of said stepping motor.

2. An automatic electronic tuning device as in claim 1 wherein said coupling means comprises a tuning hammer.

3. An automatic electronic tuning device as in claim 1 further comprising:

a plurality of visual display elements, each element being responsive to an associated one of said gated sequences of enabling pulses to provide a visual display indicative of the difference between said first and second frequencies.

4. An automatic electronic tuning device as in claim 3 wherein said visual display elements are configured in a circle to provide a visual rotating display when said first and second frequencies are unequal, and a visually stationary display when said frequencies are equal.

5. An automatic electronic tuning device as in claim 1 including a frequency standard for providing a reference frequency to said driving means as said first frequency.

6. An automatic electronic tuning device as in claim 5 wherein said frequency standard provides reference frequencies which are frequencies of the chromatic scale.

* * * * *

UNITED STATES PATENT AND TRADEMARK OFFICE

CERTIFICATE OF CORRECTION

PATENT NO. : 4,196,652

DATED : April 8, 1980

INVENTOR(S) : Jef Raskin

It is certified that error appears in the above-identified patent and that said Letters Patent are hereby corrected as shown below:

On the front page of the patent where the inventor's address is indicated, delete "P. O. Box 11044-A, Palo Alto, Calif. 94306" and insert --10696 Flora Vista, Cupertino, Calif. 95014--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*